US006553620B2

(12) United States Patent
Guillemet et al.

(10) Patent No.: US 6,553,620 B2
(45) Date of Patent: Apr. 29, 2003

(54) BALANCING SPRING SYSTEM FOR SLIDING WINDOW SASH

(75) Inventors: Guy Guillemet, Terrebonne (CA); Yvon Soucy, Laval Québec (CA); Daniel Varin, Brossard (CA)

(73) Assignee: Ferco Architectural Hardware, Laval Québec ( * ) Notice: Subject to any disclaimer, the term of this patent is extended or adjusted under 35 U.S.C. 154(b) by 7 days.

(21) Appl. No.: 09/779,507

(22) Filed: Feb. 9, 2001

(65) Prior Publication Data

US 2002/0116786 A1 Aug. 29, 2002

(51) Int. Cl.[7] ..... E05F 1/00
(52) U.S. Cl. ..... 16/197; 49/445; 49/447
(58) Field of Search ..... 16/197, 198, 193; 49/445, 447

(56) References Cited

U.S. PATENT DOCUMENTS 1,626,018 A * 4/1927 Wagniere
2,226,721 A * 12/1940 Huff
2,635,282 A * 4/1953 Trammell, Sr. et al.
2,873,472 A * 2/1959 Foster
2,885,725 A * 5/1959 Glass, Jr.
3,381,415 A * 5/1968 Nachtsheim
3,452,480 A * 7/1969 Foster
3,475,865 A * 11/1969 Arnes
4,935,987 A * 6/1990 Sterner, Jr. ..... 16/198
4,961,247 A * 10/1990 Leitzel et al. ..... 16/197
5,157,808 A * 10/1992 Sterner, Jr. ..... 16/197
5,232,208 A * 8/1993 Braid et al. ..... 267/156
5,353,548 A * 10/1994 Westfall ..... 49/446
5,463,793 A * 11/1995 Westfall ..... 16/197
6,378,169 B1 * 4/2002 Batten et al. ..... 16/197
6,393,661 B1 * 5/2002 Braid et al. ..... 16/197

* cited by examiner

*Primary Examiner*—Anthony Knight
*Assistant Examiner*—Alison K. Pickard
(74) *Attorney, Agent, or Firm*—Ogilvy Renault; Guy J. Houle

(57) ABSTRACT

A balancing spring system for facilitating the opening and the closing of a window sash assembly slidably mounted in channels of opposed window jambs comprises a connector strip. The connector strip has a front surface and a rear surface. The connector strip also has slots extending from the front surface to the rear surface. The connector strip has a connecting head section at a bottom thereof, adapted for connection to the window sash assembly. Curled ribbon springs are adapted to be mounted idle and free to rotate in each of the channels of the window jambs. The curled ribbon springs each have a free end comprising an enlarged head portion at a tip thereof, for connecting the curled ribbon springs to the slots of the connector strip, whereby the curled ribbon springs apply an upward force to the window sash assembly.

17 Claims, 3 Drawing Sheets

BALANCING SPRING SYSTEM FOR SLIDING WINDOW SASH

FIELD OF THE INVENTION

The present invention relates to sliding window sash systems and, more particularly, to a balancing spring system for facilitating the manual opening and closing of window sashes.

BACKGROUND OF THE INVENTION

Double hung and single hung windows known in the art comprise vertically translating window sashes. The window sashes slide in channels located alongside the window jambs of a window frame. Either sash can overlap the other sash to provide varying openings of the window. A window sash generally comprises, at its top end, a locking mechanism to engage the window sash in a stationary position along the window jambs.

Balancing spring systems have been provided to facilitate the opening and closing of window sashes. For instance, window sashes having large dimensions, thick glass or many layers of glass would be a handful to manually lift. Furthermore, such heavy window sashes would also be subject to the risk of forcefully sliding down the window jambs, possibly causing the shattering of the glass and endangering the people of the surrounding environment. Therefore, balancing spring systems known in the art provide spring mechanisms along window jambs to upwardly bias the window sash, such that only a small amount of force needs to be applied to the window sash for the lifting and opening thereof. Also, the window sash is kept in vertical balance within the channels of the window jambs by the spring mechanism. Similarly, only a small amount of force needs to be applied to the window sash for the closing thereof.

Curled ribbon springs have been used in balancing spring systems as they have the distinct advantage of providing a constant force, whereby the counterbalancing of the window sash is possible by opposing the constant force of such springs to the constant weight of the window sash. A curled ribbon spring consists in a spring ribbon curled around a reel, whereby the ribbon has been formed such that, when a free end portion thereof is extended and uncurled from the reel, that extended free end portion recurls itself around the reel. The recurling force of the curled ribbon spring is a function of the width thereof, amongst other factors.

U.S. Pat. No. 5,232,208, issued on Aug. 3, 1993 to Braid et al., discloses a frame tensioning arrangement, wherein a ribbon spring is curled to a reel. The curled ribbon spring is idle and free to rotate within a channel of a window jamb. A tongue at a free end of the curled ribbon spring is connected to a window sash shoe. The window sash shoe supports a window sash and comprises a pivoting mechanism enabling the latter to pivot outwardly of the window jambs. The window sash shoe is also slidably mounted in the channel of the window jamb, such that the window sash may move vertically. The curled ribbon spring applies an upward force on the window sash via the shoe, for facilitating the opening and the closing of the window sash.

If the amount of upward force required to counterbalance the window sash is greater than what can be provided by the curled ribbon spring in place, a few possibilities are at hand to increase the force thereof. As mentioned above, the width of the curled ribbon spring can be increased, but only to a certain extent as the available space within the channel is a limitation.

Because of the restricted space in the channels of the window jambs, curled ribbon springs have been added in series in window jamb channels rather than having an increase in width to enhance the biasing force thereof. The prior art system of the above referred-to patent discloses slots and indentations on the tongue of the free end of the first curled ribbon spring, whereby a second curled ribbon spring can be attached thereto, for the afore-mentioned purpose. Furthermore, the first and second curled ribbon springs are identical, whereby other curled ribbon springs can be added in series.

However, it is found that adding either slots or indentations weakens the ribbon spring. Furthermore, the area comprising the slots or indentations is subject to a greater stress as it serves as connections means and thus sustains the biasing forces of the added curled ribbon springs. This may result in the premature failure of the curled ribbon spring. In this case, the repair is a lengthy and inconvenient operation as it requires the removal of the window sash. Furthermore, as the ribbon springs are in series, the replacement of a broken ribbon spring may require the removal of the ribbon springs connected thereto, thereby extending the repair time.

It is also found that when using stacks of curled ribbon springs that are interconnected as shown in the above described prior art, the lowest curled ribbon spring does not require to be as long as the highest one. This involves keeping an inventory of different lengths of curled ribbon springs for one size of window sash.

SUMMARY OF THE INVENTION

It is a feature of the present invention to provide a balancing spring system for facilitating the manual opening and closing of window sashes and substantially overcoming the above mentioned disadvantages of the prior art.

According to the above feature of the present invention, from a broad aspect, the present invention provides a balancing spring system for facilitating the opening and the closing of a window sash assembly slidably mounted in channels of opposed window jambs. The balancing spring system comprises a connector strip having an elongated rectangular shape defining a front surface and a rear surface. The connector strip also has at least two slots formed therein. Each of the slots extends from the front surface to the rear surface. The connector strip has a connecting head section at a bottom end thereof, adapted for connection to a window sash. At least a first and a second curled ribbon spring are adapted to be mounted idle and free to rotate in one of the channels of the window jambs. The first and second curled ribbon spring each have a connecting free end section, for connecting the first and second curled ribbon spring to the slots of the connector strip, whereby the first and second curled ribbon springs apply an upward force to the window sash assembly.

According to a further broad aspect of the present invention there is provided a connector strip adapted for connecting a window sash assembly slidably mounted in channels of opposed window jambs to a biasing mechanism applying an upward force to the window sash assembly. The connector strip has an elongated rectangular shape defining a front surface and a rear surface and at least two slots therein. Each of the slots extends from the front surface to the rear surface and is adapted for connecting the connector strip to the biasing mechanism. The connector strip has a connecting head section at a bottom thereof adapted for connecting the connector strip to the window sash assembly.

BRIEF DESCRIPTION OF THE DRAWINGS

A preferred embodiment of the present invention will now be described in detail having reference to the accompanying drawings in which.

DESCRIPTION OF PREFERRED EMBODIMENTS

Figure 1:
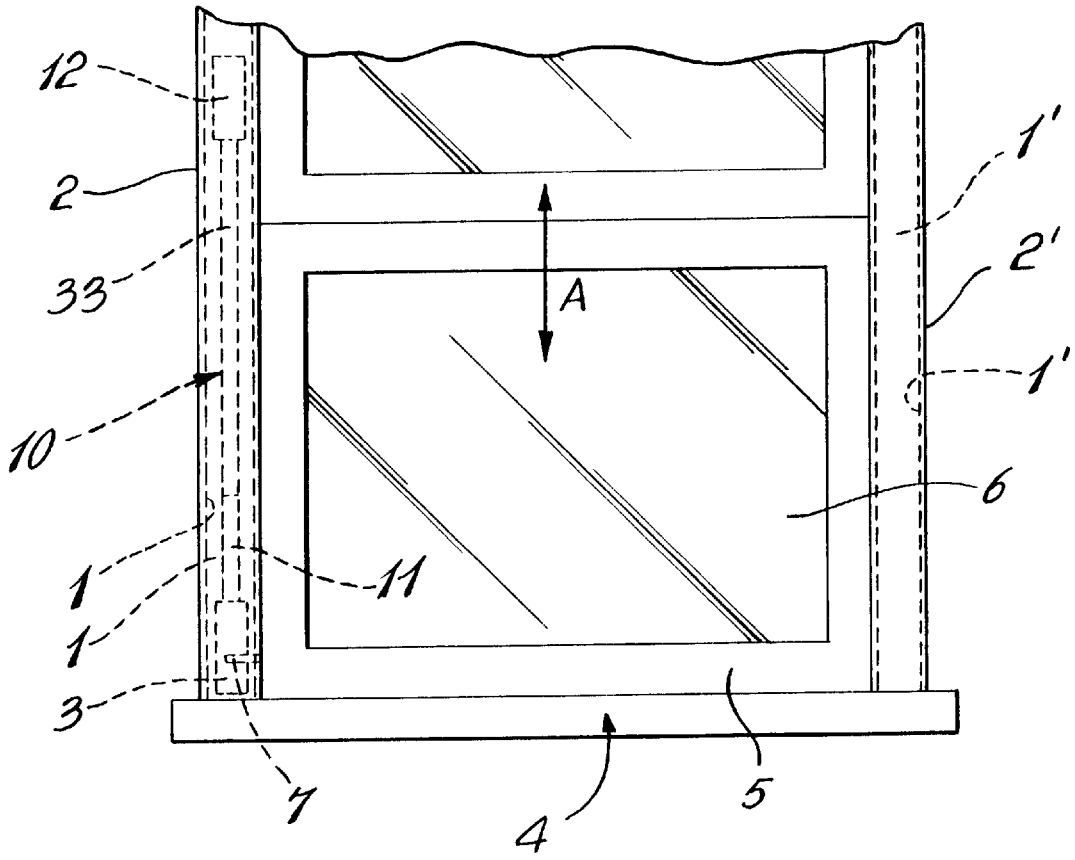
FIG. 1 is a schematic front elevational view, partly fragmented, of a balancing spring system mounted to a window sash assembly in accordance with the present invention.
Figure 2:
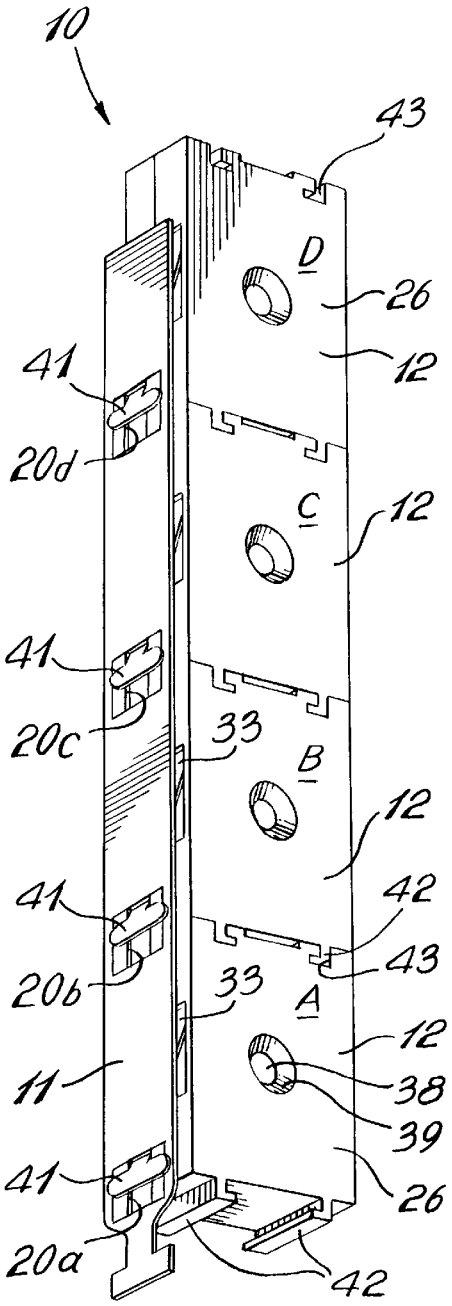
FIG. 2 is a perspective view of the balancing spring system.

According to the drawings and more particularly to FIGS. 1 and 2, a balancing spring system in accordance with the present invention is generally shown at 10, FIG. 1 showing the location thereof in a window frame. The balancing spring system is shown secured in a channel 1 to a window jamb 2, and connected to a window sash shoe 3. The shoe 3 is slidably mounted in the channel 1. A window sash 4 comprises a frame member 5 and a glass 6. The frame 5 is connected to the shoe 3 by a pivot 7, whereby the window sash 4 translates vertically in response to the sliding motion of the shoe 3 in the channel 1, as demonstrated by arrow A. Still referring to FIG. 1, only one balancing spring system 10 is shown, but the opposed window jamb 2' also has a channel 1' holding an identical balancing spring system (not shown). However, in some applications, a single balancing system may be provided in one of the channels.

Figure 3:
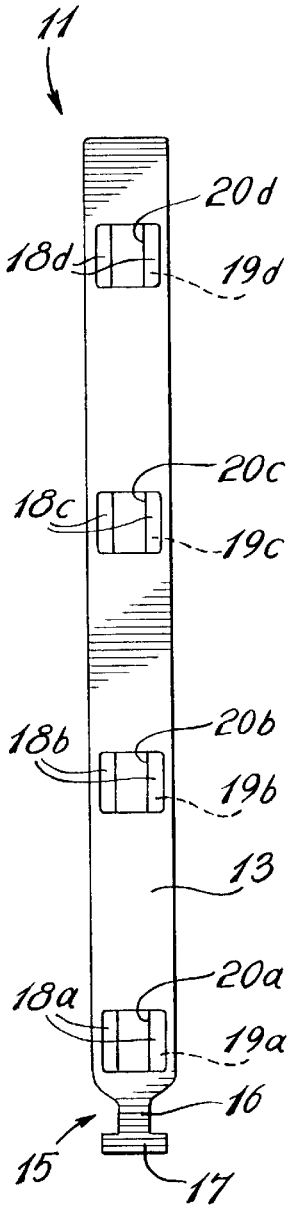
FIG. 3 is a front elevational view of a connector strip in accordance with the present invention.
Figure 4:
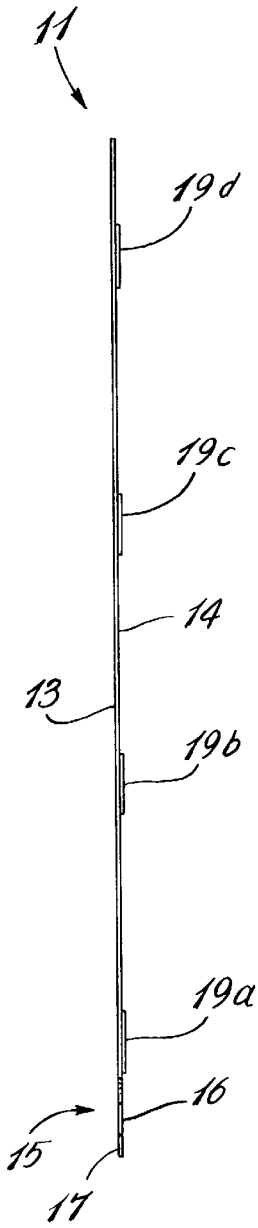
FIG. 4 is a side elevational view of the connector strip.

As best shown in FIG. 2, the balancing spring system 10 comprises a connector strip 11 and a plurality of spring cassettes 12 (e.g. four cassettes) removably secured to the connector spring 11. Referring now to FIGS. 3–4, it can be seen that the connector strip 11 is an elongated rectangular strip having a front surface 13 and a rear surface 14. An inverted T-shaped connector portion 15 is located at a bottom end thereof, and comprises a throat section 16 and a horizontal end section 17. The throat section 16 is of narrowed width with respect to the width of the connector strip 11.

The connector strip 11 further comprises pairs of indentations 18*a*, 18*b*, 18*c* and 18*d* in the front surface 13 thereof, disposed on each side of a slot 20*a*, 20*b*, 20*c* and 20*d*, respectively. The indentations 18*a*, 18*b*, 18*c* and 18*d* are generally equally spaced apart therein, with the indentation 18*a* being adjacent the bottom end of the connector strip 11 and the indentation 18*d* adjacent a top end thereof. Corresponding protrusions 19*a*, 19*b*, 19*c* and 19*d* are formed on the rear surface 14 as a result from the indentations 18*a*, 18*b*, 18*c*, and 18*d*, respectively. The slots 20 are generally rectangular-shaped and vertically oriented on a central longitudinal axis of the connector strip 11.

The connector strip 11 is adapted to be secured to a window sash shoe, such as the shoe 3 of FIG. 1, by its inverted T-shaped connector portion 15 being held captive therein, as known in the art. The connector strip 11 will thereafter be connected to spring cassettes 12, as will be explained hereinafter.

Figure 5:
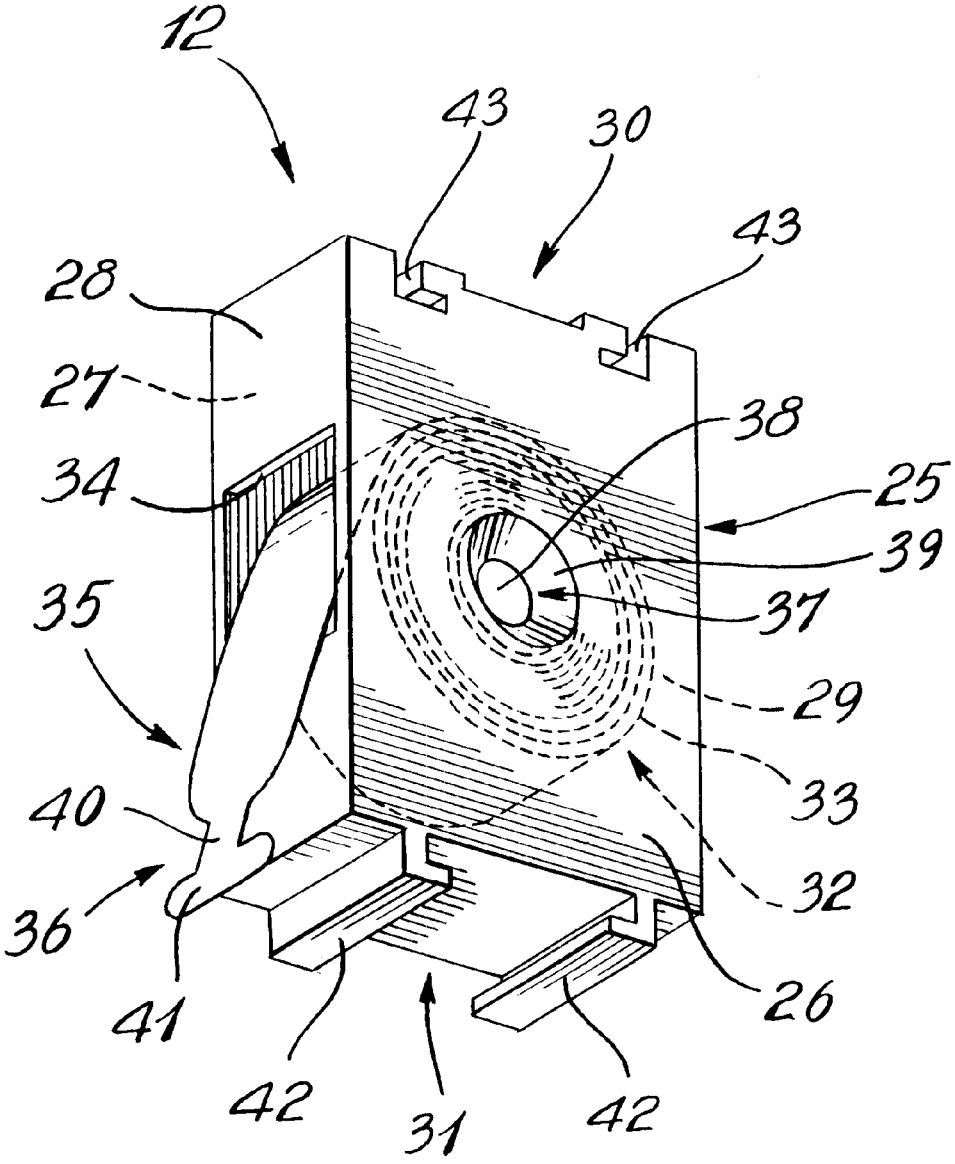
FIG. 5 is a perspective view of a spring cassette in accordance with the present invention.

Referring to FIG. 5, there is shown one of the cassettes 12. The cassette 12 comprises a casing 25, defined by a front wall 26, a rear wall 27, side walls 28 and 29, a top wall 30 and a bottom wall 31. A reel 32 of curled ribbon spring 33 is enclosed in the casing 25. The reel 32 of curled ribbon spring 33 is idle and free to rotate within the casing 25. An opening 34 is defined in the side wall 28. The opening 34 is sized such that a free end 35 of the ribbon spring 33 can be displaced therethrough. An inverted T-shape connector portion 36 is located at the tip of the free end 35. The T-shape connector portion 36 has a vertical throat section 40 and a horizontal end section 41. The vertical throat section 40 is of narrowed width with respect to the width of the curled ribbon spring 33.

A hole 37 is generally centered in the front wall 26 of the cassette and extends through to the rear wall 27 thereof. The hole 37 is bounded by a cylindrical wall 38. A countersink 39 is located between the cylindrical wall 38 and the front wall 26. The portion of the cylindrical wall 38 within the casing 25 serves as a pivot for the reel 32 of curled ribbon spring 33. Furthermore, the hole 37 and the countersink 39 are sized to receive a fastening element therein, such as a screw. Consequently, the spring cassette 12 can be fixedly mounted to a window jamb, within a channel, as shown in FIG. 1.

Still referring to FIG. 5, the spring cassette 12 also comprises legs 42 downwardly projecting from the bottom wall 31, and complementary grooves 43 in the top wall 30 thereof. As shown in FIG. 2, similar cassettes 12 can be connected together one on another to form a stack. For instance, the legs 42 of a cassette B are mounted in complementary engagement with the grooves 43 of cassette A. Although the curled ribbon spring 33 has been described as being enclosed in a casing, it is readily understood that the curled ribbon spring 33 may be mounted with a different type of support to the channel of a window jamb.

According to the window sash weight, the available space in the window jamb channels and the upward force supplied by a cassette, the number of cassettes required for the counterbalancing of the window sash is determined. For instance, a stack of four cassettes 12 is shown in FIG. 2. Once the stack of cassettes 12 is assembled, it is secured in the channel alongside the window jamb, as schematically shown in FIG. 1. As described above, fasteners such as screws are used for this purpose. It is noted that the stack of cassettes 12 is disposed above the top of the window sash 4, such that the upward force thereof may be supplied throughout the vertical displacement of the window sash 4. Also, a connector strip 11 is fixedly mounted to the shoe 3, as described previously.

When the connector strip 11 is mounted to the shoe 3, and the stack of cassette 12 is secured within the channel 1, the curled ribbon springs 33 of each cassette 12 of the stack is connected to the connector strip 11. As best shown in FIG. 2, this is achieved by the inverted T-shape connector portion 36 of the free end 35 of the curled ribbon spring 33 being captively engaged in the slot 20/indentation 18 configuration of the connector strip 11. It is noted that the narrowed width of the vertical member 40 of the T-shape connector portion 36 is generally similar to the width of the slot 20 of the connector strip 11, whereby the horizontal member 41 is abutted at both its ends on either side of the slot 20. As shown in FIG. 2, cassettes A, B, C and D are connected to the slots 20*a*, 20*b*, 20*c* and 20*d*, respectively. It is also noted that the indentations 18*a*–18*d* allow for the horizontal members 41 of the curled ribbon spring 33 connected thereto to be generally co-planar with the front surface 13 of the connector strip 11, whereby optimizing the space utilization. It is noted that other connection means may be used to secure the free ends 35 of the curled ribbon springs 33 to the connector strip 11, such as corresponding hooks and slots, fasteners or the like.

When the balancing spring system 10 is connected to the window sash 4 on each side thereof, a portion of the curled ribbon spring 33 is extended out of its cassette 12, whereby it exerts an upward force on the window sash 4 as it is biased to recurl. Thus, the window sash 4 is subject to the constant upward force of the balancing spring system 10 connected thereto, whereby it remains idle in any vertical position along the window jamb 2 as it is also subject to the downward force of its weight. In consequence thereof, only a slight amount of force needs to be applied to displace the window sash 4 vertically upon the window jamb 2.

As the connector strip 11 need not be resilient materials, it may be comprised of a strong or reinforced rigid materials, whereby it can sustain stress for longer periods and thus be more durable. Accordingly, the attachment between the cassettes and the sash is much stronger with the use of the connector strip than the prior art systems and the curled ribbon springs 33 are not weakened at their connecting point as is the case with some of the prior art, as discussed herein. Furthermore, the curled ribbon springs 33 of the stack of cassettes 12 are independently connected to the connector strip 11, whereby they can individually be replaced in the event of a ribbon spring failure. The distance between the slots 20 of the connector strip 11 is generally equivalent to the distance between the curled ribbon springs 33. This ensures that the curled ribbon springs 33 can all be of the same length, whereby the need to keep an inventory of various lengths of curled ribbon spring for one size of window sash is eliminated.

It is within the ambit of the present invention to cover any obvious modifications of the embodiments described herein, provided such modifications fall within the scope of the appended claims.

What is claimed is:

1. A balancing spring system for facilitating the opening and the closing of a window sash assembly slidably mounted in channels of opposed window jambs, said balancing spring system comprising:

a connector strip having an elongated rectangular shape defining a front surface and a rear surface, at least two slots formed in said connector strip, each of said slots extending from said front surface to said rear surface; said connector strip having a connecting head section at a bottom end thereof, adapted for connection to a window sash;

at least a first and a second curled ribbon spring adapted to be mounted idle and free to rotate in one of said channels of said window jambs, said first and second curled ribbon spring each having a connecting free end section, for releasably connecting each of said first and second curled ribbon spring to a respective one of said slots of said connector strip, whereby said first and second curled ribbon springs apply an upward force to said window sash assembly.

2. The balancing spring system according to claim 1, wherein identical ones of said balancing spring system are mounted on opposed window jambs.

3. The balancing spring system according to claim 1, wherein said connecting head section of said connector strip has a throat section and a head section.

4. The balancing spring system according to claim 3, wherein said connecting free end section of said curled ribbon springs each have a throat section and a head section for releasably connecting with said slots.

5. The balancing spring system according to claim 4, wherein said slots of said connector strip are disposed in indentations of said front surface, such that said head section of said curled ribbon spring is co-planar with said front surface when connected thereto.

6. The balancing spring system according to claim 1, wherein said curled ribbon springs are each enclosed in a casing having top and bottom walls, side walls and front and rear walls; one of said side walls having an opening therein for displacement said free end of said curled ribbon springs therethrough.

7. The balancing spring system according to claim 6, wherein a hole extends from said front wall to said rear wall, for receiving a fastener therein.

8. The balancing spring system according to claim 7, wherein said hole is centered on said front and rear walls.

9. The balancing spring system according to claim 8, wherein a countersink is located between said hole and said front wall.

10. The balancing spring system according to claim 8, wherein a surface defined by said hole within the casing serves as pivot for said curled ribbon spring.

11. The balancing spring system according to claim 6, wherein at least a leg extends from said bottom wall of each of said casing.

12. The balancing spring system according to claim 11, wherein said top wall of each of said casing comprises a groove, each of said groove corresponding to said legs of said casing, for the stacking of casing one on top of another.

13. The balancing spring system according to claim 1, wherein the number of said curled ribbon springs is chosen as a function of an upward force required for balancing the window sash assembly.

14. A connector strip adapted for connecting a window sash assembly slidably mounted in channels of opposed window jambs to a biasing mechanism applying an upward force to said window sash assembly, said connector strip having:

an elongated rectangular shape defining a front surface and a rear surface;

at least two slots in said connector strip, each of said slots extending from said front surface to said rear surface and adapted for releasable connection of said connector strip to said biasing mechanism; said connector strip having a connecting head section at a bottom thereof adapted for connecting said connector strip to said window sash assembly.

15. The connector strip according to claim 14, wherein said connecting head section has a throat section and a head section.

16. The connector strip according to claim 14, wherein said slots of said connector strip are enclosed in indentations of said front surface, adapted for receiving connecting means of said biasing mechanism in co-planar relation with said front surface.

17. A balancing spring system for facilitating the opening and the closing of a window sash assembly slidably mounted in channels of opposed window jambs, said balancing spring system comprising:

a connector strip having an elongated rectangular shape defining a front surface and a rear surface, at least two slots formed in said connector strip, each of said slots extending from said front surface to said rear surface, the slots being aligned with respect to one another in a longitudinal vertical dimension of the connector strip and spaced by a given distance; said connector strip having a connecting head section at a bottom end thereof, adapted for connection to a window sash;

at least a first and a second curled ribbon spring adapted to be mounted idle and free to rotate in a vertical dimension of one of said channels of said window jambs, the curled ribbon springs being generally spaced by said given distance, the curled ribbon springs each having a connecting free end section, for connecting said curled ribbon spring to said slots of said connector strip such that the curled ribbon springs have a same length, whereby said first and second curled ribbon springs apply an upward force to said window sash assembly.

* * * * *